US006244627B1

(12) United States Patent
Wolff et al.

(10) Patent No.: US 6,244,627 B1
(45) Date of Patent: Jun. 12, 2001

(54) FOLDER WITH OVERLAPPING WINDOWS

(75) Inventors: Scott S. Wolff; Marcia Elizabeth Lausen, both of Evanston; Stephan Peter James Pfanner; Meeyoung Chung Melamed, both of Chicago, all of IL (US)

(73) Assignee: Acco Brands, Inc., Lincolnshire, IL (US)

( * ) Notice: Subject to any disclaimer, the term of this patent is extended or adjusted under 35 U.S.C. 154(b) by 0 days.

(21) Appl. No.: 09/396,789

(22) Filed: Sep. 15, 1999

(51) Int. Cl.[7] ..... B42D 3/00

(52) U.S. Cl. ..... 281/29; 402/73; 402/79; 281/31

(58) Field of Search ..... 281/29, 31, 38, 281/37, 45; 402/70, 73, 80, 79; 229/67.1

(56) References Cited

U.S. PATENT DOCUMENTS

| | | | | |
|---|---|---|---|---|
| 3,107,043 | | 10/1963 | Jones | 229/92.3 |
| 4,200,222 | | 4/1980 | Feuer | 229/92.8 |
| 4,301,962 | * | 11/1981 | Monckton et al. | 281/31 X |
| 4,583,764 | * | 4/1986 | Steffen | 281/31 |
| 4,636,179 | | 1/1987 | Gentile et al. | 402/79 |
| 4,640,413 | * | 2/1987 | Kaplan et al. | 281/31 X |
| 4,971,361 | | 11/1990 | Whiting | 281/2 |
| 4,991,767 | | 2/1991 | Wyant | 229/1.5 R |
| 5,031,935 | | 7/1991 | D'Andrea | 281/15.1 |
| 5,141,485 | | 8/1992 | Welt | 493/210 |
| 5,598,969 | | 2/1997 | Ong | 229/67.1 |
| 5,836,507 | * | 11/1998 | Mueller et al. | 229/67.1 |
| 5,882,038 | | 3/1999 | Ong | 281/31 |
| 5,988,685 | * | 11/1999 | Mogelonsky et al. | 281/31 |

* cited by examiner

*Primary Examiner*—Willmon Fridie, Jr.
(74) *Attorney, Agent, or Firm*—Pennie & Edmonds LLP

(57) ABSTRACT

The present invention is directed to a sheet holder, a first panel defining a first window having a first window area, and a second panel defining a second window having a second window area. The first and second panels are joined by at least one hinge, such that the first and second panels are foldable about the hinge to a folded position with the first panel disposed over the second panel. In the folded position, the first and second windows are in overlap with each other such that the first window area overlaps substantially less than the entire second window area.

20 Claims, 4 Drawing Sheets

FOLDER WITH OVERLAPPING WINDOWS

FIELD OF THE INVENTION

This invention relates generally to sheet holders, and more particularly to folders for holding materials having overlapping windows disposed on the folder for targeted display of title information.

BACKGROUND OF THE INVENTION

Documents such as promotional packages are commonly prepared for distribution and later retrieval by others. It is often desirable to bind these documents in a holder that presents a visually pleasing appearance while facilitating the review of the contents contained therein. It is known to provide folders with internal pockets for receiving documents and securing the same between the protective covers of the folder. To facilitate the organization and identification of the documents contained within the folder, content identifiers such as labels are generally affixed to the front cover of the folder.

Various forms of content identifiers are known in the art and have been incorporated into folders. The simplest form is attaching inscribed self-adhesive labels to the front cover of the folder. Also commonly used are transparent plastic materials, typically rectangular in shape that are either heat sealed or adhesively attached to the spine or the front cover into which a label can be inserted.

Another known alternative is to form front and back covers of transparent sheets of material. A folder of this type displays the top sheet of the document contained therein as a title sheet, which may easily be prepared using laser printing technology.

U.S. Pat. No. 5,882,038 is directed to a document folder having front and back covers and interior pockets. The front cover of the folder is formed with title viewing windows. A title backing has tabs that secure a sheet of standard sized paper and engages the front cover to display the printed information on the sheet of paper through the windows. The backing is shown as an extension flap to the folder and folded over the front cover. Alternatively, the backing sheet is a separate sheet and is insertable within the interior pocket on the front cover.

Further, U.S. Pat. No. 3,107,043 discloses a filing folder for holding security certificates. The folder has front and back covers pivotably connected along a spine. A large window is centered over the front cover. An insert sheet having a small window centered thereon is insertable between the front and back covers such that when the folder is closed, the small window is exposed entirely by the large window of the front cover. The insert sheet is substantially smaller than the front and back covers, and pressure sensitive tapes are used to secure the insert sheet over a security certificate to ensure that only the name of the owner of the certificate is displayed.

Also, U.S. Pat. No. 5,031,935 is directed to a book with apertures disposed on the comers of the pages contained inside. The apertures overlap to display images affixed to the insides of front and rear covers of the book.

SUMMARY OF THE INVENTION

The present invention is directed to a sheet holder having a first panel defining a first window with a first window area and a second panel defining a second window with a second window area. The first and second panels are joined by at least one hinge, such that the first and second panels are foldable about the hinge to a folded position with the first panel disposed over the second panel. In the folded position, the first and second windows arc in overlap with each other such that the first window area overlaps substantially less than the entire second window area. A display holder having a pocket is disposed on the second panel for receiving a display sheet. The second window is configured to display a display portion of the display sheet held within the pocket, and the first window is configured to display less than the entire display portion.

DESCRIPTION OF THE PREFERRED EMBODIMENT

Figure 1:
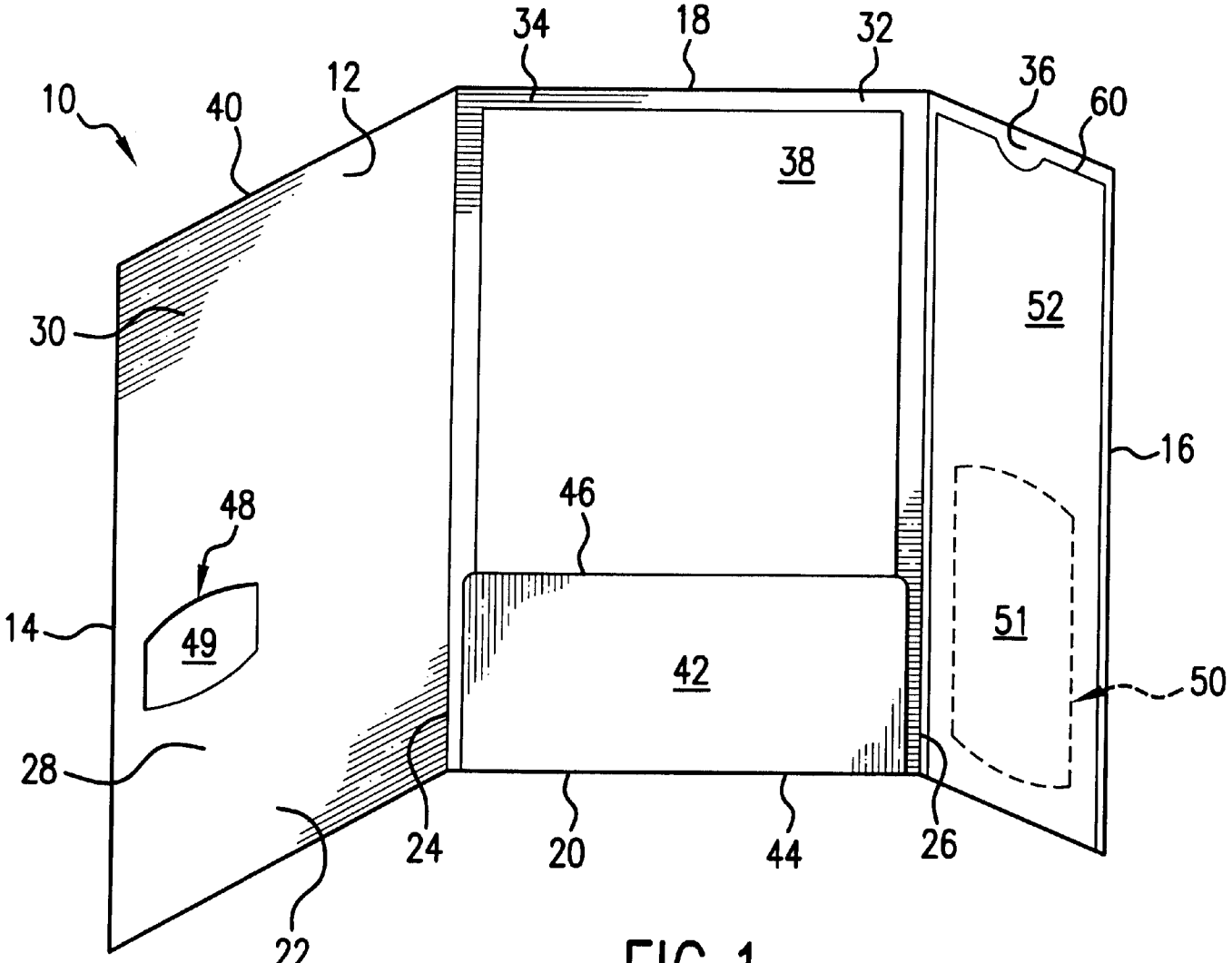
FIG. 1 is a perspective view of an embodiment of a sheet holder constricted according to the present invention.
Figure 2:
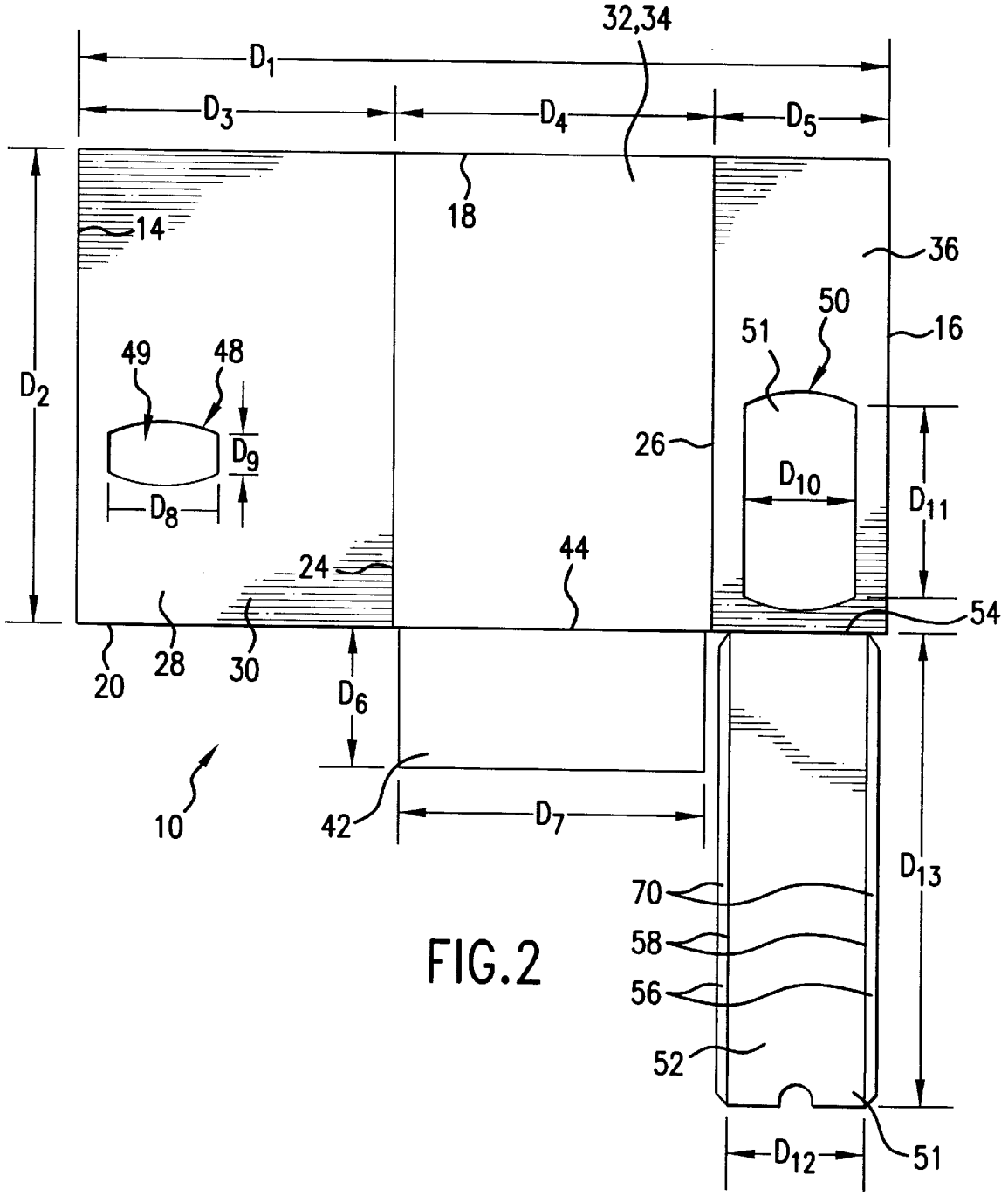
FIG. 2 is a view of the interior of the sheet holder of FIG. 1 shown in an unassembled configuration.

Referring to FIGS. 1 and 2, a preferred embodiment of a sheet holder 10, such as a report cover or a folder, is shown having a base sheet 12, which preferably is of a unitary construction and defines outer edges 14, 16, 18 and 20. Specifically, FIG. 1 shows an interior surface 22 of the assembled folder 10 when the folder 10 is partially open, and FIG. 2, in general, illustrates the preassembled base sheet 12 as a blank. When the folder 10 is assembled, elements toward the bottom of the drawings in FIG. 2 are folded inwards toward the interior surface 22 of the folder 10, as will be described hereinafter.

Preferably, the base sheet 12 includes first and second score lines, or alternatively hinges, 24 and 26, extending generally longitudinally between the set of oppositely disposed edges 18 and 20. Base sheet 12 is folded along score lines 24 and 26 to form three panels 28, 32, 36, which preferably form a front cover 30, a back cover 34, and a side extension 36. The side extension 36 and the back cover 34 may alternatively be a part of the same panel or as an extension thereof. Panels 28 and 32 include an exterior surface 40, facing the exterior of the folder 10 when the folder 10 is in a closed configuration. Similarly, the panels 28 and 32 include interior surface 22, facing the interior of the folder 10 when the folder 10 is the closed configuration or position. In contrast, both of the interior and exterior surfaces 22 and 40 of the side extension 36 face the interior of the folder 10 when the folder 10 is the closed configuration.

The folder 10 is preferably dimensioned to accommodate documents 38 of standard size sheets of papers with sufficient clearance to protect the document contained therein from external elements. An example of such sheets of paper for the document 38 is the standard letter size, 8½×11 inch, A4, or legal size. Accordingly, the dimensions of the front cover 30 and back cover 34 must be sufficient to fully cover the contents stored therebetween. The folder 10 has a lateral length D1 preferably extending from outer edge 14 to outer edge 16, and a longitudinal length D2, extending from outer edge 18 to outer edge 20. Preferably the longitudinal length D2 of the holder 10 provides a clearance of at least about ⅛ inches on all sides for the documents contained therein. Preferably the lateral length $D_1$ is sufficient to accommodate the preferred dimensions of the front cover 30, back cover 34 and the side extension 36. The front cover has a lateral dimension D3, extending from outer edge 14 to score line 24. Dimension D3 is preferably sufficient to provide a clearance of at least about ⅛ inches on all sides of the document contained therein. The back cover 34 has a lateral dimension D4, extending between score lines 24 and 26. Preferably D4 is slightly larger than D3 to ensure proper folding of the front cover 20 toward the back cover 34 in an overlapping assembly. Side extension 36 has a lateral dimension D5, extending between score line 26 and outer edge 16. The relationship of dimension D5 in relation to the other elements of the holder will be discussed in detail hereinafter.

The base sheet 12 preferably has a bottom extension or base flap 42, best seen from the vantage of the unassembled folder 10 in FIG. 2. Base flap 42 is disposed along outer edge 20 and is adjacent to the panel 32 of the folder 10. Preferably, the base flap 42 is foldable in an overlapping association with the interior surface 22 of the panel 32. Most preferably, the base flap 42 is integrally constructed with the base sheet 12 and adjacent to the panel 32, defining a score line or flap hinge 44. The base flap 42 is foldable in an overlapping assembly with the interior surface 22 of the panel 32 of the folder 10. Folding the base flap 42 over the interior surface 22 of the panel 32 forms a pocket 46 therebetween, for retaining sheets of the document 38. In an alternative embodiment, the lateral edges of the flap 42 can be secured to panel 32 to close the edges of the pocket.

As shown in FIGS. 1 and 2, the base flap 42 preferably has slightly tapered lateral sides, extending from flap hinge 44. Other shapes of the base flap 42, however, may also be used, such as triangular, and securing flaps can be formed on either side of the base flap and securable with adhesives to fix the sides of the base flap 42 to the interior surface 22 of the panel 32 to form a pocket, or other sheet holders.

The base flap 42 has a longitudinal dimension D6, extending from the score line 44 to the outer edge of the flap, and a lateral dimension D7, extending from the lateral edges thereof. Dimension D7 is preferably slightly less than dimension D4 of the back cover 34 to facilitate folding of the covers 30 and 34 and side extension 36, ensuring smooth overlapping engagement of these elements. Dimension D6 can be any length, but it is preferred that dimension D6 be less than longitudinal dimension D2 of the base sheet 12. The dimension D6, however, must be sufficient to properly hold the documents 38 contained therein. The considerations in selecting the proper dimension D6 include size and thickness of the document contained therein and cost of materials for manufacture. Preferably, the longitudinal dimension D6 of the base flap 42 is less than ½ and greater than ¼ of the longitudinal dimension D2 of the base sheet. Most preferably, the longitudinal dimension D6 of the base flap 42 is about ⅓ of the longitudinal dimension D2 of the base sheet 12.

The panel 28 also includes a first window 48 disposed between outer edge 14 and score line 24. First window 48 has a first window area 49 and can be positioned anywhere on the front cover 30, but preferably, the first window 48 is disposed in the outer lateral half of the panel 28, closest to outer edge 14. Most preferably, the first window 48 is approximately centered both laterally and longitudinally within the first outer half of the panel 28. The side extension 36 includes a second window 50, which may be positioned anywhere on the side extension 36, but preferably centrally disposed between score line 26 and outer edge 16. The second window 50 defines a second window area 51. Preferably, the second window area 51 is greater than first window area 49.

The positions of first and second windows 48 and 50 are coordinated such that when the folder 10 is in an assembled position with the side extension 36 folded over the interior surface 22 of the panel 32 and the front cover 30 similarly folded thereafter, exposing only the exterior surfaces 40 of the folder 10, the first and second windows 48 and 50 are in overlap. The lateral position of second window 50 is preferably limited to the lateral dimensions D5 of the side extension 36 and the longitudinal dimension D2 of the base sheet 12. Accordingly, the first window 48 is so positioned, within the first lateral half of the panel 28, to accommodate the size of the side extension 36. Preferably, the first and second windows 48 and 50 are aligned such that the first window 48 covers a portion of the second window 50 when the folder 10 is closed. Most preferably, the first and second windows 48 and 50 are aligned such that the first window 48 is completely contained within the boundary of the second window 50 when the folder is closed. Second window 50, however, may also be positioned to extend beyond the side extension 36.

As shown in FIG. 2, the first window 48 has a lateral dimension D8 and a longitudinal dimension D9, and the second window 50 has a lateral dimension D10 and a longitudinal dimension D11. Preferably lateral dimension D8 of the first window 48 is less than lateral dimension D10 of the second window 50, and longitudinal dimension D9 of the first window 48 is less than longitudinal dimension D11 of the second window. The correlations between the size of windows 48 and 50 will be discussed in greater detail hereinafter in relation to the assembly and use of folder 10. Also, windows 48 and 50 are shown having a curved longitudinal outer edges to provide a more visually pleasing appearance. Windows 48 and 50 having straight sides, however, are equally suitable. Additionally, windows 48 and 50 may have a circular shape any other non-rectangular shape. The shape of the first window 48 preferably corresponds to the shape of second window 50, but alternatively may be a different shape.

First and second windows 48 and 50 may be cut-outs on base sheet 12, or if base sheet 12 is formed of a polymeric material silk-screened for an opaque appearance or an actual opaque polymeric material, the windows 48 and 50 may be clear portions of the polymeric material without the application of the silk-screen. Additionally, in the case of cut-outs, windows 48 and 50 may be covered with a transparent material to provide protection for contents exposed through the windows 48 and 50.

The base sheet 12 further includes a display holder 51 shown in FIG. 2 as a pocket panel 52. The pocket panel 52 is similarly constructed as the base flap 42 and is in an overlapping condition with the interior surface 22 of the side extension 36. Most preferably, the pocket panel 52 is integrally constructed with the base sheet 12 along outer edge 20 adjacent to the side extension 36 and is defined by a second base score line 54. The pocket panel 52 is foldable along score line 54 into the overlapping assembly with the interior surface 22 of the side extension 36 of the folder 10, forming a pocket 60 therebetween. Preferably, the pocket panel 52 is constructed with securing flaps 56 extending along the lateral sides of the pocket panel 52. In the preferred embodiment, score lines 58 are defined at the interface between the securing flaps 56 and the pocket panel 52.

The pocket panel 52 has a lateral dimension D12 and a longitudinal dimension D13. Lateral dimension D12 of the pocket panel 52 is preferably less than the lateral dimension D5 of the side extension 36 to ensure proper securement of the pocket panel 52 thereto. Additionally, the longitudinal dimension D13 of the pocket panel 52 is preferably less than longitudinal dimension D2 of the base sheet 12 to prevent the pocket panel 52 from protruding beyond the outer edge 18. The correlation of the lateral and longitudinal dimensions D12 and D13 of the pocket panel 52 with respect to the other elements of folder 10 will be described in greater detail hereinafter. The display holder 51 is shown as a pocket panel 52 forming a pocket 60. Other devices for holding displays are also suitable, including, clips, releaseable adhesives, tabs, and velcro strips.

Figure 3:
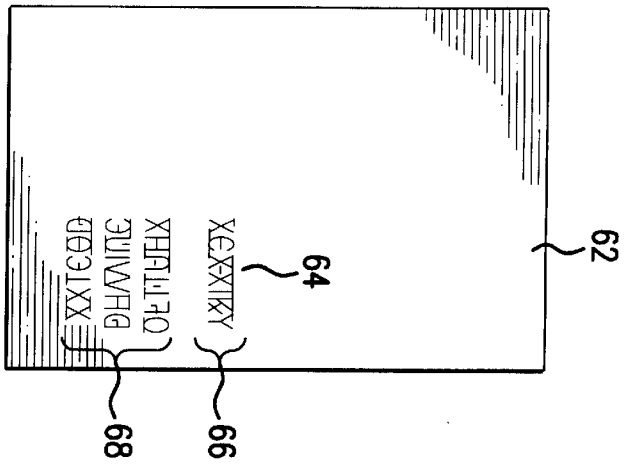
FIG. 3 is a view of a title sheet.

A title sheet 62, as shown in FIG. 3 is receivable within the pocket 60 containing display material 64. Display material 64 may be disposed on the title sheet for identifying the content of the folder 10. Display material 64 is positioned on the title sheet 62 such that when the title sheet 62 is inserted within the pocket 60, the display material 64 is displayed through the second window 50. Most preferably, the title sheet 62 corresponds to the size of the document stored within the folder 10. A user may prepare the display of the title sheet 62 for the folder 10 along with the document for storage therein. Display material 64 is preferably divided into two portions, 66 and 68. The first portion 66 of the display material 64 preferably contains main heading type of information, while the second portion 68 of the display material 64 contains subheading type of information.

Figure 5:
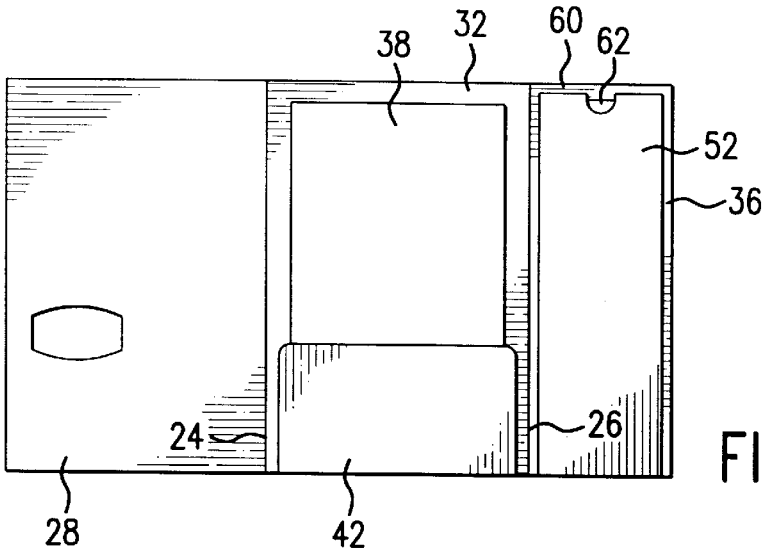
FIG. 5 is an interior of the sheet holder in FIG. 4, showing the inserted title sheet and document.

Referring to FIG. 2 for a preferred illustration of the assembly of the folder 10 according to the preferred embodiment. As stated previously, the folder 10 is preferably constructed from a single sheet, stamped into the unassembled configuration, having panels 28 and 32, side extension 36, base flap 42 and pocket panel 52 with securing flaps 56. The base flap 42 is folded along fold line 44 toward the interior surface 22 of the panel 32 of the folder 10. The securing flaps 56 are folded along fold lines 58 toward the pocket panel 52. Preferably adhesives 70 are applied to the surface of the securing flap 56 opposed to the pocket panel 52. The pocket panel 52 is thereafter folded along fold line 54 toward the side extension 36, allowing the adhesive to secure the securing flap 56 to the side extension 36 and forming the pocket 60 with the interior surface 22 of the extension panel. Other securing methods, including stitching, taping, welding, and stapling, are also suitable. A completely assembled folder 10 of the preferred embodiment according to the present invention is shown in FIGS. 1 and 5.

The sheet holder 10 may have slightly curved outer edge 14 to the front cover 30 with rounded corners to further improve the overall appearance and durability of the folder 10. Similarly, the bottom flap 42 may be slightly tapered extending from edge 20 and have rounded comers. The folder 10 of the present invention may be constructed of a number of materials to protect the contents contained therein. In view of providing ease of manufacturing and minimizing costs while achieving greater flexibility of usage, the base sheet 10 is preferably fabricated from a single sheet of material constructed of typical stiff paper, card board, bristol board or plastic. The panels 28 and 32 and side extension 36, however, may also be individual pieces pivotally connected along score lines 24 and 26. The card board may be opaque, plastic coated or textured. The base sheet 10 may also be constructed from a transparent sheet silk-screened into an opaque sheet except for the first and second windows for displaying information therethrough. Most preferably, the base sheet 10 is constructed from stiff paper.

As stated above, the various dimensions of the elements of the folder 10 are preferably correlated and mainly dependent upon the dimension of the document 38 contained therein. For example, the lateral dimensions D3 of the front cover 30 is preferably greater than the lateral dimension of the document 38 contained in the folder 10, providing protection thereof. Most preferably, the lateral dimension D3 provides a clearance of about ⅛ inch on both lateral sides of the document 38. Accordingly, to accommodate proper placement of the front cover 30 of the folder 10 in a closed configuration, the lateral dimension D4 of the back cover 34 is preferably greater than the lateral dimension D3 of the front cover 30.

As stated previously, the title sheet 62 is preferably prepared at the same time as the document 38, having the same overall dimensions. Accordingly, the lateral dimension D12 of the pocket panel 52 preferably corresponds to the lateral dimension of the title sheet 62 and document 38, to ensure that the title sheet 62 is properly received within the pocket 60. Preferably, the lateral dimension D12 of the pocket panel 52 is about ¾ of the lateral dimension of the title sheet 62. More preferably, the lateral dimension D12 of the pocket panel 52 is between 40% to 60% of the lateral dimension of the title sheet 62. Most preferably, the lateral dimension D12 of thc pocket panel 52 is about ½ of the lateral dimension of the title sheet 62, allowing the title sheet 62 to be folded longitudinally in half and inserted within the pocket 60.

The dimensions of windows 48 and 50 will now be described in relation to the display information 64 on the title sheet 62. As stated previously, the display information 64 is preferably divided into first and second portions 64 and 66. As also previously stated, the windows 48 and 50 are preferably aligned with respect to each other and positioned on the folder 10 such that when the folder 10 is in a closed configuration, the first window 48 is completely contained within second window 50. Windows 48 and 50 may, however, only be partially aligned. It is preferred that only the first portion 66 of the display material 64 is displayable through the first window 48 when the folder is in the closed configuration. Upon opening the folder by turning the front cover 30, both portions 66 and 68 of the display material 64 are displayable through the second window 50, which is shown when the front cover 30 is in the opened configuration.

As a non-limiting example of the dimensions of the most preferred embodiment, a folder 10 constructed according to the present invention to accommodate standard 8½×11 inch sheets of paper has a front cover 30 with dimensions about 8⅞×11⅞ inches, a back cover 34 with dimensions about 9⅛×11⅞ inches, and the side extension 36 with dimensions about 4⅝×11⅞ inches. The pocket panel 52 preferably has a lateral dimension less than the side extension 36, about 4⅜×11⅞ inches. The bottom flap 42 has a dimension sufficient to secure the sheets of document 38 stored within the folder 10, preferably with a dimension about 8⅞×4¾ inches. The title sheet 62 is preferably the same as the sheets of document 38 contained within the folder 10 and is about 8½×11 inches. The first window 48 is preferably 2¾×1¼ inches and is positioned about 1½ inches from outer edge 14 and 5⅛ inches from outer edge 18. Similarly, the second window 50 is preferably 3×5½ inches and is disposed about ⅞ inches from outer edge 16 and about 5 inches from outer edge 18.

Figure 4:
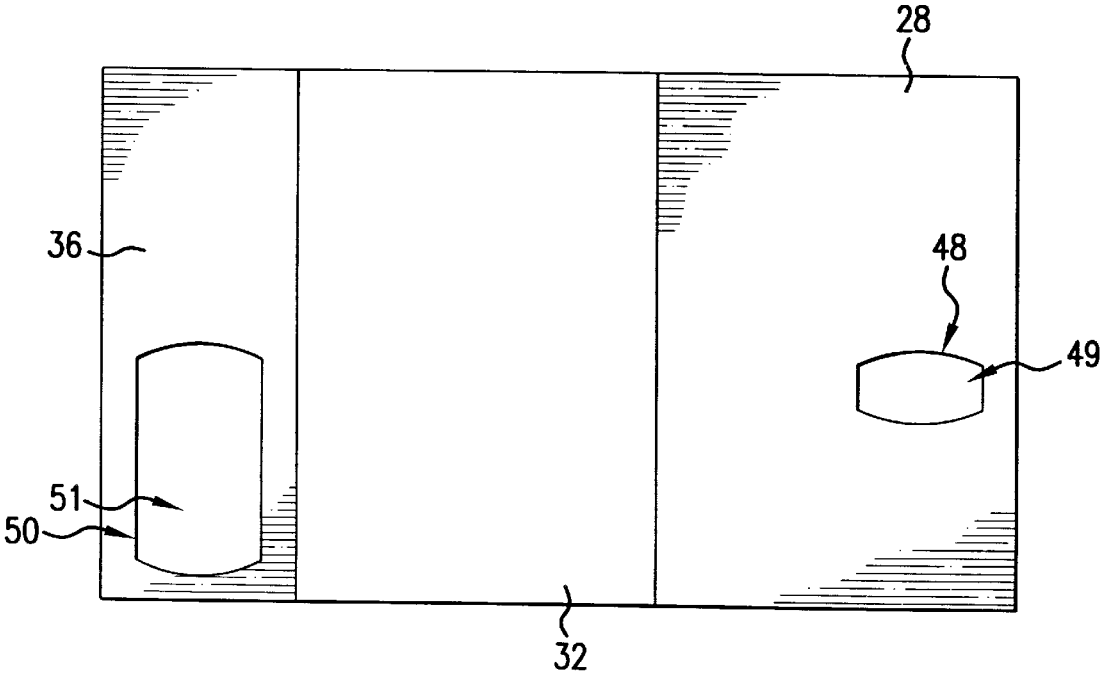
FIG. 4 is an outside view of the exterior of the sheet holder of FIG. 2 in an assembled and opened configuration, showing the inserted title sheet.
Figure 6:
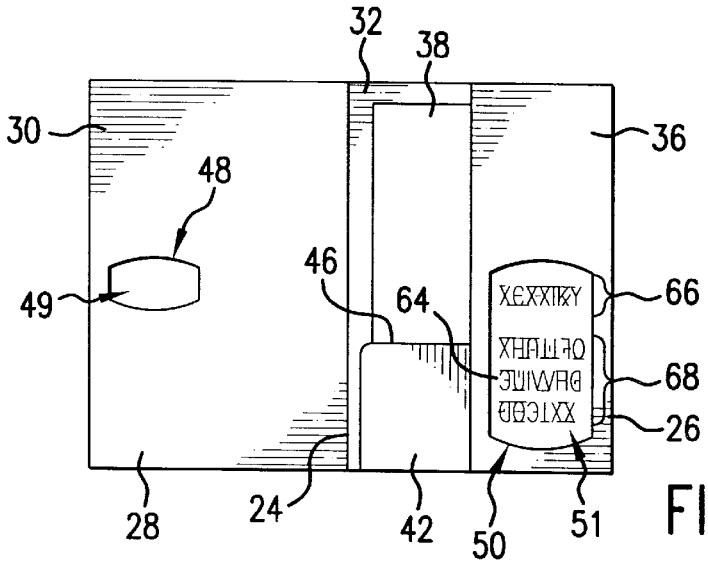
FIG. 6 is the sheet holder of FIG. 5 in a partially opened configuration.
Figure 7:
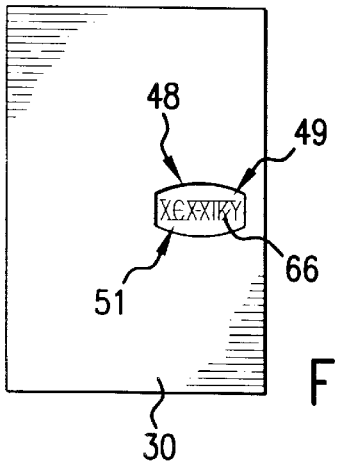
FIG. 7 is the sheet holder of FIG. 6 in a closed configuration.

FIGS. 5–7 show the steps of using the folder 10 of the present invention for displaying information. The display material 64 is disposed on the title sheet 42 preferably using conventionally available laser printers. Most preferably, the display material 64 is printed on a longitudinal half of the title sheet 62. The title sheet 62 containing display material 64 is folded longitudinally in half and inserted within the pocket 60 with the display material 64 displayed through the second window 50, as shown in FIG. 4. The document 38 to be contained within the folder 10 is placed between the bottom flap 42 and the panel 32 and between score lines 24 and 26 and preferably in substantial alignment therewith. The bottom flap 42 holds the document 38 in place within the folder 10. The side extension 36 is folded toward the panel 32 along score line 26, as shown in FIG. 6. The side extension 36 further secures the document 38 within the folder 10, minimizing lateral movement of the document. FIG. 6 illustrates the display of first and second portions 66 and 68 of display material 64 displayed through the second window 50 of the side extension 36. Thereafter, the panel 28, or front cover 30, is folded over toward the panel 32 along score line 24, as shown in FIG. 6. FIG. 7 illustrates the first window 48 displaying only the first portion 66 of the display material 64 displayed through the second window 50. Accordingly, a visually pleasing and functionally effective presentation is obtained with the folder of the present invention. Additionally, as the folder 10 is retrieved for view by a subsequent user, the first portion 66 of the display material 64, preferably containing the main heading, is displayed through the first window 48, as shown in FIG. 7, with the remaining second portion 68 of the display material 64 covered by the front cover 30. In the closed configuration, the sheets of document 38 are contained within pocket 46 secured by bottom flap 42 and side extension 36. Upon opening the front cover 30, the remaining second portion 68 of the display material 66, a subheading or other information, is shown through the second window 50 in addition to the first portion 66 of the display material 64, as shown in FIG. 6. The use of standard sized paper allows users the option of easily printing title and caption information using conventionally available laser printers. By selectively positioning the printed information 64 on the title sheet 62, the folder 10 of the present invention allows a user to segment the display of the information, such as exposing only a title or heading in the first portion 66 when the folder 10 is closed and exposing more detailed description of the materials contained in the folder 10 in portion 68 of the display material 64 when the front cover 30 is open, resulting in a folder 10 with a great visual appearance and not the same time functionally desirable.

One of ordinary skill in the art can envision numerous variations and modifications to the invention disclosed herein. For example, the adhesive strip of the fourth panel of the spine may be applied separately by the user at the time of assembly, eliminating the need of a protective cover, or the spine may be constructed as a separate sheet from the back cover and attachable thereto. All of these modifications are contemplated by the true spirit and scope of the following claims.

What is claimed is:

1. A folder comprising:

(a) a first panel defining a first window having a first window area; and (b) a second panel defining a second window having a second window area and joined to the first panel by at least one hinge, such that the first and second panels are foldable about the hinge to a folded position with the first panel disposed over the second panel;

wherein in the folded position, the first and second windows are in overlap with each other such that the first window area overlaps substantially less than the entire second window area.

2. The folder of claim 1, wherein the first and second panels arc foldable to an opened position wherein the first panel is folded away from the second panel, exposing a greater portion of the second window area.

3. The folder of claim 1, wherein the second window area is larger than the first window area.

4. The folder of claim 1, wherein the first window has a width in a first direction and the second window has a second width in the first direction larger than the first width.

5. The folder of claim 1, wherein in the folded position the first window substantially completely overlaps the second window such that the entire first window area is disposed within the second window area.

6. The folder of claim 1, wherein the second panel includes a display holder configured and dimensioned for holding a sheet behind and visible through the second window area.

7. The folder of claim 6, wherein the display holder includes a pocket.

8. The folder of claim 6, wherein first panel has a first panel width and the display holder has a holder width of between about 40% and 60% of the first panel width.

9. The holder of claim 6, wherein the display holder has a display panel width perpendicular to the at least one hinge and the first panel has a first panel width such that the display panel width is about ½ of the first panel width.

10. The folder of claim 6, wherein the second window is configured to display a display portion of a display sheet held in the display holder and the first window area is positioned and configured to display less than the entire display portion.

11. The folder of claim 1, further comprising a third panel disposed between the first and second panels, wherein the at least one hinge comprises first and second hinges connecting the third panel to the first and second panel.

12. The folder of claim 11, wherein the first and second hinges are disposed on opposite sides of the third panel.

13. The folder of claim 11, further comprising a sheet holder connected to the third panel configured for holding sheets adjacent the third panel.

14. The folder of claim 13, wherein the sheet holder comprises a flap foldably connected at a flap hinge to the third panel.

15. The folder of claim 1, wherein the first and second panels are part of a single unitary sheet of material.

16. A folder comprising:

(a) a first panel defining a first window having a first window area;

(b) a second panel defining a second window having a second window area and joined to the first panel by at least one hinge, such that the first and second panels are foldable about the hinge to a folded position with the first panel disposed over the second panel; and (c) a display holder having a pocket and disposed on the second panel and configured and dimensioned for receiving a display sheet having a display portion visible through the second window;

wherein in the folded position, the first and second windows and the display holder are at least partially in overlap with each other.

17. The folder of claim 16, wherein the first panel has a first panel width, and the pocket has a pocket width of between about 40% and 60% of the first panel width.

18. A folder comprising (a) an interior surface;

(b) an exterior surface disposed on an opposite side of the folder from the interior surface;

(c) a first panel defining a first window that extends from the interior surface to the exterior surface; and (d) a second panel defining a second window that extends from the exterior surface toward the interior surface is covered by the interior surface;

wherein the first and second panels are joined by at least one hinge such that the first and second panels are pivotable about the hinge to a folded position with the first panel disposed over the second panel such that the second window is visible through the first window.

19. The folder of claim 18, wherein the second panel comprises an interior layer and an exterior layer, and the second window extends only through the exterior layer.

20. The folder of claim 18, wherein the second window is configured to display a first portion of a display and the first window is positioned and configured to display a part of said first portion of the display.

* * * * *

UNITED STATES PATENT AND TRADEMARK OFFICE

CERTIFICATE OF CORRECTION

PATENT NO. : 6,244,627 B1 
DATED : June 12, 2001
INVENTOR(S) : Scott S. Wolff; Marcia Elizabeth Lausen; Stephen Peter James Pfanner; Meeyoung Chung Melamed It is certified that error appears in the above-identified patent and that said Letters Patent is hereby corrected as shown below:

Column 8,
Line 6, replace "arc" with -- are --.

Signed and Sealed this

Eighth Day of January, 2002

*Attest:*

*Attesting Officer*

JAMES E. ROGAN
*Director of the United States Patent and Trademark Office*